US008584822B2

(12) United States Patent
Buller et al.

(10) Patent No.: US 8,584,822 B2
(45) Date of Patent: Nov. 19, 2013

(54) CLOSED LOOP STRAP HANDLE FOR A PIECE OF LUGGAGE THAT HAS BEEN MODIFIED TO HAVE THE CLOSED LOOP STRAP HANDLE REPLACEABLY ADDED THEREON

(75) Inventors: Joshua Lynn Buller, New York, NY (US); Paul V. Scicluna, Penndel, PA (US)

(73) Assignee: Tumi, Inc., South Plainfield, NJ (US)

( * ) Notice: Subject to any disclaimer, the term of this patent is extended or adjusted under 35 U.S.C. 154(b) by 188 days.

(21) Appl. No.: 12/806,652

(22) Filed: Aug. 18, 2010

(65) Prior Publication Data

US 2012/0006639 A1 Jan. 12, 2012

Related U.S. Application Data

(60) Provisional application No. 61/399,194, filed on Jul. 8, 2010.

(51) Int. Cl.
*A45C 13/22* (2006.01)

(52) U.S. Cl.
USPC ..... 190/116; 190/39; 150/107; 16/114.1; 16/406

(58) Field of Classification Search
USPC ..... 150/107, 108; 190/39, 116, 117, 115; 224/218, 219, 929, 651; 16/113.1, 16/114.1, 406, 419; 294/149; 383/13, 25
See application file for complete search history.

(56) References Cited

U.S. PATENT DOCUMENTS

| | | | | | |
|---|---|---|---|---|---|
| 1,241,890 | A * | 10/1917 | Schrader | 190/116 |
| 1,333,618 | A * | 3/1920 | Hegerhorst | 190/101 |
| 1,376,528 | A * | 5/1921 | Colin | 190/116 |
| 1,427,608 | A * | 8/1922 | Lotz | 16/406 |
| 1,471,385 | A * | 10/1923 | Critchley | 190/101 |
| 1,640,522 | A * | 8/1927 | Morris et al. | 150/108 |
| 2,720,208 | A * | 10/1955 | Gellman | 132/297 |
| 3,001,566 | A * | 9/1961 | Lipsitz | 224/610 |
| 3,653,474 | A * | 4/1972 | Sadow | 190/18 A |
| 3,854,558 | A * | 12/1974 | Corson | 190/116 |
| 3,912,140 | A * | 10/1975 | Franges | 294/166 |
| 3,924,872 | A * | 12/1975 | Sollazzi et al. | 190/18 A |
| 4,424,841 | A * | 1/1984 | Smith | 224/240 |
| 4,558,896 | A * | 12/1985 | Farnworth | 294/156 |
| 5,119,910 | A * | 6/1992 | Heggeland | 190/116 |
| 5,603,545 | A * | 2/1997 | Benson et al. | 294/150 |
| 5,950,893 | A * | 9/1999 | Heggeland | 224/578 |
| 6,032,916 | A * | 3/2000 | Holliday | 248/505 |
| 6,772,485 | B2 * | 8/2004 | Alpert | 24/300 |
| 6,968,880 | B2 * | 11/2005 | Battaglia et al. | 150/103 |
| 7,160,028 | B1 * | 1/2007 | Linday | 383/4 |
| 2001/0027834 | A1 * | 10/2001 | Southwick | 150/108 |
| 2006/0260725 | A1 * | 11/2006 | Kawakita | 150/108 |

* cited by examiner

*Primary Examiner* — Sue A Weaver
(74) *Attorney, Agent, or Firm* — Jon Fallon, Esq.

(57) ABSTRACT

A closed loop strap handle for a piece of luggage that has been modified to have the closed loop strap handle replaceably added thereon. The closed loop strap handle includes a strap, and apparatus for replaceably having the closed loop strap handle added onto the piece of luggage. The apparatus sits within the piece of luggage. The strap replaceably engages into the apparatus and loops to replaceably engage itself.

20 Claims, 2 Drawing Sheets

CLOSED LOOP STRAP HANDLE FOR A PIECE OF LUGGAGE THAT HAS BEEN MODIFIED TO HAVE THE CLOSED LOOP STRAP HANDLE REPLACEABLY ADDED THEREON

1. CROSS REFERENCE TO RELATED APPLICATIONS

The instant non-provisional patent application claims priority from provisional patent application No. 61/399,194, filed on Jul. 8, 2010, for a CLOSED LOOP STRAP HANDLE FOR A PIECE OF LUGGAGE THAT HAS BEEN MODIFIED TO HAVE THE CLOSED LOOP STRAP HANDLE REPLACEABLY ADDED THEREON, and incorporated herein by reference thereto.

2. BACKGROUND OF THE INVENTION

A. Field of the Invention

An embodiment of the present invention relates to a looped strap handle for a piece of luggage, and more particularly, an embodiment of the present invention relates to a closed loop strap handle for a piece of luggage that has been modified to have the closed loop strap handle replaceably added thereon.

B. Description of the Prior Art

Numerous innovations for luggage handles have been provided in the prior art. Even though these innovations may be suitable for the specific individual purposes to which they address, however, they differ from an embodiment of the present invention in that they do not teach a closed loop strap handle for a piece of luggage that has been modified to have the closed loop strap handle replaceably added thereon.

3. SUMMARY OF THE INVENTION

Thus, an object of an embodiment of the present invention is to provide a closed loop strap handle for a piece of luggage that has been modified to have the closed loop strap handle replaceably added thereon, which avoids the disadvantages of the prior art.

Briefly stated, another object of an embodiment of the present invention is to provide a closed loop strap handle for a piece of luggage that has been modified to have the closed loop strap handle replaceably added thereon. The closed loop strap handle includes a strap, and apparatus for having the closed loop strap handle replaceably added onto the piece of luggage. The apparatus sits within the piece of luggage. The strap replaceably engages into the apparatus and loops to replaceably engage itself.

The novel features considered characteristic of an embodiment of the present invention are set forth in the appended claims. An embodiment of the present invention itself, however, both as to its construction and to its method of operation together with additional objects and advantages thereof will be best understood from the following description of a specific embodiment when read and understood in connection with the accompanying figures of the drawing.

4. BRIEF DESCRIPTION OF THE FIGURES OF THE DRAWING

The figures of the drawing are briefly described as follows.

5. LIST OF REFERENCE NUMERALS UTILIZED IN THE FIGURES OF THE DRAWING

Figure 1:
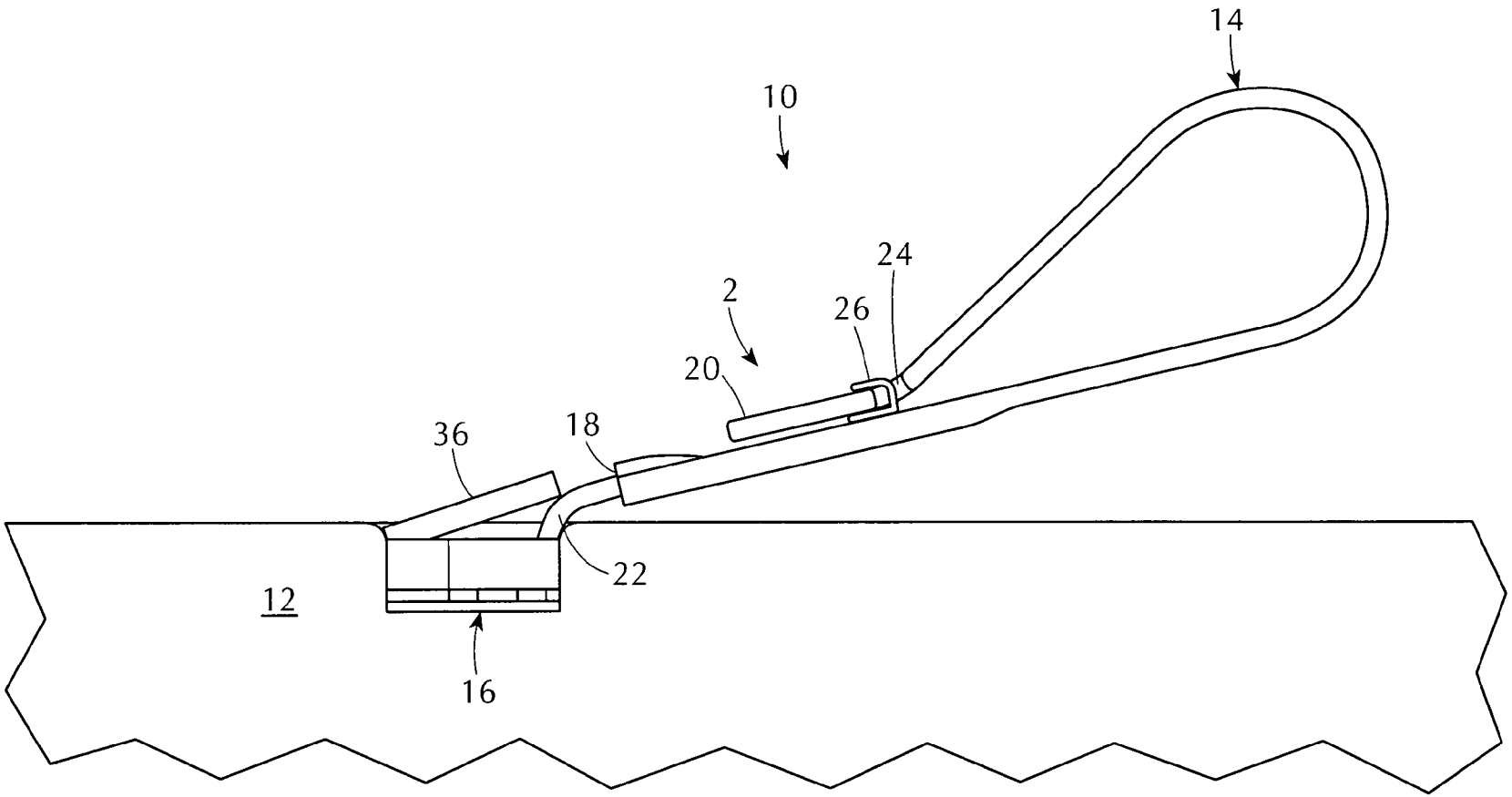
FIG. 1 is a diagrammatic side elevational view of the closed loop strap handle of an embodiment of the present invention on a piece of luggage that has been modified to have the closed loop strap handle replaceably added thereon.

A. General.

10 closed loop strap handle of embodiment of present invention for piece of luggage 12 that has been modified to have closed loop strap handle 10 replaceably added thereon

12 piece of luggage

B. Overall Configuration of Closed Loop Strap Handle 10.

14 strap

16 apparatus for having closed loop strap handle 10 replaceably added onto piece of luggage 12

C. Specific Configuration of Strap 14 and Apparatus 16.

(1) Specific Configuration of Strap 14.

18 proximal end of strap 14

20 distal end of strap 14

22 prong of proximal end 18 of strap 14

24 pair of lateral recesses in distal end 20 of strap 14

26 pair of hooks of strap 14

(2) Specific Configuration of Apparatus 16.

28 base plate of apparatus 16

30 bracket of apparatus 16

32 through slot in bracket 30 of apparatus 16

34 pair of bearing caps of bracket 30 of apparatus 16

36 door of apparatus 16

38 depending sleeve of door 36 of apparatus 16

40 pivot pin of apparatus 16

42 coil spring of apparatus 16

6. DETAILED DESCRIPTION OF THE PREFERRED EMBODIMENTS

A. General.

Referring now to the figures, in which like numerals indicate like parts, and particularly to FIG. 1, which is a diagrammatic side elevational view of the closed loop strap handle of an embodiment of the present invention on a piece of luggage that has been modified to have the closed loop strap handle replaceably added thereon, the closed loop strap handle of an embodiment of the present invention is shown generally at 10 for a piece of luggage 12 that has been modified to have the closed loop strap handle 10 replaceably added thereon.

B. Overall Configuration of the Closed Loop Strap Handle 10.

The closed loop strap handle 10 comprises a strap 14, and apparatus 16 for having the closed loop strap handle 10 replaceably added onto the piece of luggage 12. The apparatus 16 sits within the piece of luggage 12. The strap 14 replaceably engages into the apparatus 16 and loops to replaceably engage itself.

C. Specific Configuration of the Strap 14 and the Apparatus 16.

Figure 2:
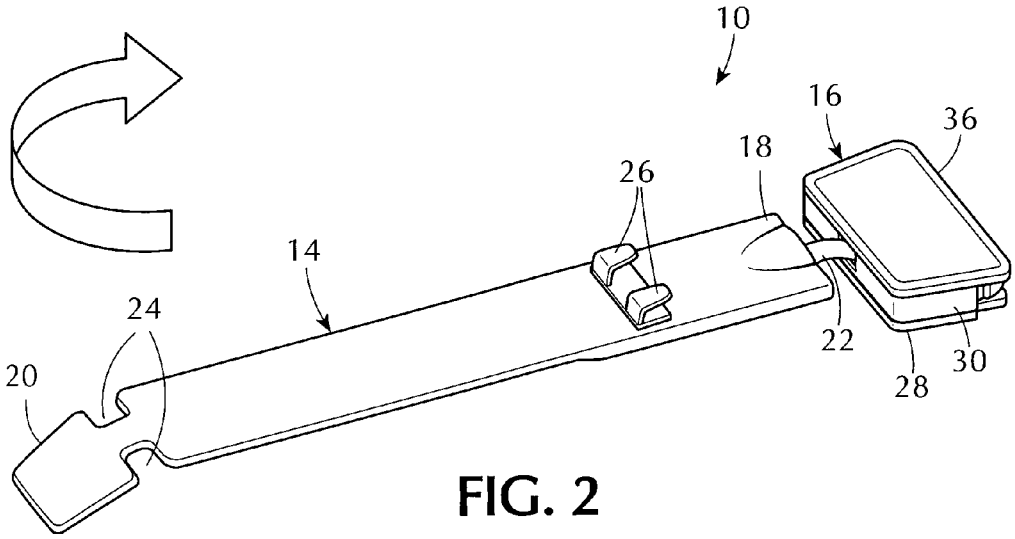
FIG. 2 is a diagrammatic perspective view of the closed loop strap handle of an embodiment of the present invention identified by ARROW 2 in FIG. 1, but in the unlooped position.
Figure 3:
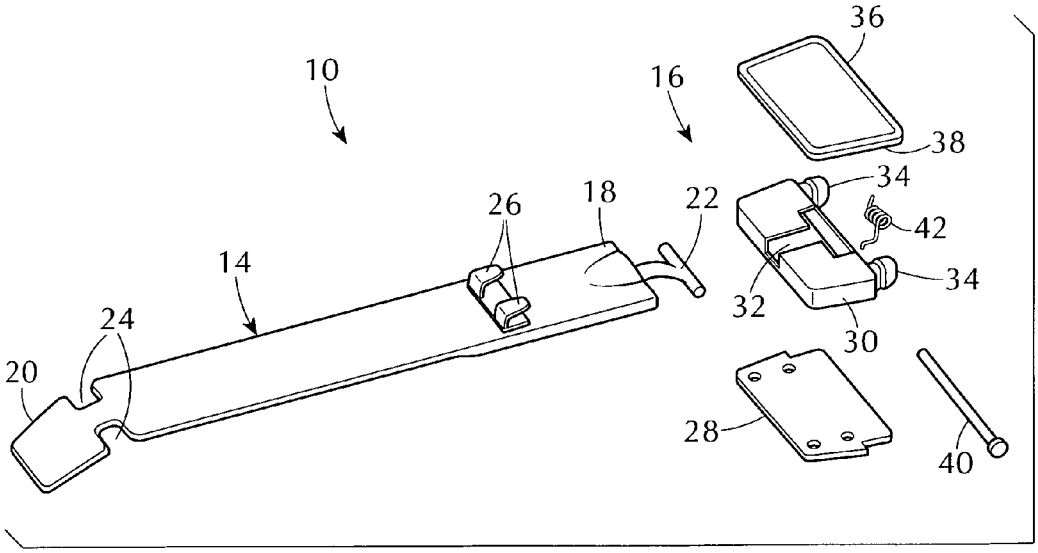
FIG. 3 is a reduced exploded perspective view of the closed loop strap handle of an embodiment of the present invention shown in FIG. 2.

The specific configuration of the strap 14 and the apparatus 16 can best be seen in FIGS. 2 and 3, which are, respectively, a diagrammatic perspective view of the closed loop strap handle of an embodiment of the present invention identified by ARROW 2 in FIG. 1, but in the unlooped position, and a reduced exploded perspective view of the closed loop strap handle of an embodiment of the present invention shown in FIG. 2, and as such, will discussed with reference thereto.

(1) Specific Configuration of the Strap 14.

The strap 14 is slender, elongated, thin, and has a proximal end 18 and a distal end 20.

The proximal end 18 of the strap 14 has a prong 22. The prong 22 of the proximal end 18 of the strap 14 extends axially outwardly therefrom, is generally T-shaped, and bends smoothly and slightly downwardly.

The distal end 20 of the strap 14 is laterally pinched to form a pair of lateral recesses 24. The pair of lateral recesses 24 in the distal end 20 of the strap 14 are aligned with each other.

The strap 14 further has a pair of hooks 26. The pair of hooks 26 of the strap 14 are laterally aligned with each other, and are disposed closer to the proximal end 18 of the strap 14 than the distal end 20 of the strap so as to engage the pair of lateral recesses 24 in the distal end 20 of the strap 14 when the strap 14 is looped and form a closed loop (FIG. 1).

(2) Specific Configuration of the Apparatus 16.

The apparatus 16 comprises a base plate 28. The base plate 28 of the apparatus 16 sits within the piece of luggage 12.

The apparatus 16 further comprises a bracket 30. The bracket 30 of the apparatus 16 sits on the base plate 28 of the apparatus 16 and is within the piece of luggage 12.

The bracket 30 of the apparatus 16 has a through slot 32. The through slot 32 in the bracket 30 of the apparatus 16 is generally T-shaped so as to replaceably receive the prong 22 of the proximal end 18 of the strap 14, and in so doing, allows the strap 14 to be replaceably added onto the piece of luggage 12.

The bracket 30 of the apparatus 16 further has a pair of bearing caps 34. The pair of bearing caps 34 of the bracket 30 of the apparatus 16 extend upwardly, and away from the base plate 28 of the apparatus 16.

The apparatus 16 further comprises a door 36. The door 36 of the apparatus 16 has a depending sleeve 38 through which the door 36 of the apparatus 16 is pivotally attached to the bracket 30 of the apparatus 16.

The apparatus 16 further comprises a pivot pin 40. The pivot pin 40 of the apparatus 16 extends through the pair of bearing caps 34 of the bracket 30 of the apparatus 16 and the depending sleeve 38 of the door 36 of the apparatus 16 so as to allow the door 36 of the apparatus 16 to be pivotally attached to the bracket 30 of the apparatus 16.

The apparatus 16 further comprises a coil spring 42. The coil spring 42 of the apparatus 16 encircles the pivot pin 40 of the apparatus 16 and biases the door 36 of the apparatus 16 closed against the prong 22 of the proximal end 18 of the strap 14 so as to allow the door 36 of the apparatus 16 to maintain the prong 22 of the proximal end 18 of the strap 14 in the through slot 32 in the bracket 30 of the apparatus 16, and in so doing, maintains the strap 14 replaceably added to the piece of luggage 12 (FIG. 1).

D. Impressions.

It will be understood that each of the elements described above or two or more together may also find a useful application in other types of constructions differing from the types described above.

While an embodiment of the present invention has been illustrated and described as embodied in a closed loop strap handle for a piece of luggage that has been modified to have the closed loop strap handle replaceably added thereon, however, it is not limited to the details shown, since it will be understood that various omissions, modifications, substitutions, and changes in the forms and details of an embodiment of the present invention illustrated and its operation can be made by those skilled in the art without departing in any way from the spirit of an embodiment of the present invention.

Without further analysis the foregoing will so fully reveal the gist of an embodiment of the present invention that others can by applying current knowledge readily adapt it for various applications without omitting features that from the standpoint of prior art fairly constitute characteristics of the generic or specific aspects of an embodiment of the present invention.

The invention claimed is:

1. A closed loop strap handle, comprising:

a strap;

a pair of lateral hooks attached to a surface of the strap;

a pair of lateral recesses positioned for detachable coupling with the pair of lateral hooks, each lateral recess comprising a pinched portion formed in the surface of the strap; and a prong extending from the strap adapted to attach to a piece of luggage, the prong comprising a T-shape.

2. The handle of claim 1, wherein said strap is slender;

wherein said strap is elongated; and wherein said strap is thin.

3. The handle of claim 1, wherein the strap has a proximal end; and wherein the prong is positioned on the proximal end.

4. The handle of claim 3, further comprising an attachment apparatus attached to a piece of luggage positioned for coupling with the prong.

5. The handle of claim 4, wherein the attachment apparatus comprises a base plate that sits within the piece of luggage.

6. The handle of claim 4, wherein the attachment apparatus comprises a bracket for attachment to a base plate.

7. The handle of claim 6, wherein the bracket sits on the base plate; and wherein the bracket sits within the piece of luggage.

8. The handle of claim 6, wherein the bracket has a through slot.

9. The handle of claim 8, wherein the through slot is generally T-shaped so as to replaceably receive the prong for replaceable attachment to the piece of luggage.

10. The handle of claim 8, wherein the bracket has a pair of bearing caps.

11. The handle of claim 10, wherein the pair of bearing caps extend upwardly and away from the base plate.

12. The handle of claim 10, wherein the attachment apparatus further comprises a door.

13. The handle of claim 12, wherein the door is pivotally attached to the bracket.

14. The handle of claim 12, wherein the attachment apparatus includes a pivot pin for coupling with the door, allowing the door to rotate about the pin.

15. The handle of claim 14, wherein the attachment apparatus further comprises a coil spring adapted to couple with the pivot pin.

16. The handle of claim 15, wherein the coil spring encircles the pivot pin; and wherein the coil spring biases the door closed against the prong so as to allow the door to maintain the prong in the through slot and replaceably attaches the strap to the piece of luggage.

17. The handle of claim 1, wherein the prong bends smoothly.

18. The handle of claim 1, wherein the strap has a distal end; and wherein the pair of lateral recesses are positioned on the distal end.

19. The handle of claim 18, wherein said pair of lateral recesses in said distal end of said strap are aligned with each other.

20. The handle of claim 18, wherein the pair of hooks are laterally aligned with each other; and wherein the pair of hooks are disposed closer to the proximal end of the strap than the distal end of the strap so as to engage the pair of lateral recesses when the strap is looped and forms a closed loop.

* * * * *